US007559635B2

(12) United States Patent
Conway et al.

(10) Patent No.: US 7,559,635 B2
(45) Date of Patent: Jul. 14, 2009

(54) APPARATUS FOR FACILITATING DETERMINATION OF PROPER SUPPLY CARTRIDGE INSTALLATION

(75) Inventors: John Yeung Conway, Louisville, KY (US); Angela Lynn Hudson, Lexington, KY (US); Gina Marie Johns, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 232 days.

(21) Appl. No.: 11/383,818

(22) Filed: May 17, 2006

(65) Prior Publication Data

US 2008/0036813 A1 Feb. 14, 2008

(51) Int. Cl.
*B41J 2/175* (2006.01)

(52) U.S. Cl. ..... 347/85; 347/86

(58) Field of Classification Search ..... 347/86, 347/85

See application file for complete search history.

(56) References Cited

U.S. PATENT DOCUMENTS

| | | | | |
|---|---|---|---|---|
| 5,422,792 | A * | 6/1995 | Neumann | 362/554 |
| 6,097,405 | A * | 8/2000 | Lo et al. | 347/6 |
| 7,089,973 | B2 * | 8/2006 | Nicodem et al. | 141/18 |
| 2005/0219857 | A1 * | 10/2005 | Klett et al. | 362/518 |

* cited by examiner

*Primary Examiner*—Brian J Goldberg
(74) *Attorney, Agent, or Firm*—Taylor & Aust, PC

(57) ABSTRACT

A supply cartridge for containing a supply of imaging substance includes a cartridge body, and a light pipe attached to the cartridge body. The light pipe has a light output, and a light input for receiving light from an external light source.

8 Claims, 9 Drawing Sheets

APPARATUS FOR FACILITATING DETERMINATION OF PROPER SUPPLY CARTRIDGE INSTALLATION

FIELD OF THE INVENTION

The present invention relates to imaging, e.g., printing, and, more particularly, to an apparatus for facilitating determination of proper supply cartridge installation in an imaging apparatus.

BACKGROUND OF THE INVENTION

An imaging apparatus forms an image in a print medium, such as paper, by applying an imaging substance, such as ink or toner, to the print medium. The imaging substance may be contained in one or more replaceable supply cartridges. Examples of such replaceable supply cartridges include an ink tank (e.g., ink reservoir), an ink jet printhead cartridge, a toner tank, and a toner cartridge. An ink jet printhead cartridge, for example, includes both an ink tank and an ink jet printhead. A toner cartridge, for example, may include both a toner tank and an electrophotographic drum.

One such imaging apparatus, for example, is an inkjet printer having mounted thereto a plurality of ink tanks, with each ink tank containing a supply of a particular color of ink. In one such ink jet printer, each ink tank is formed integral with an ink jet printhead to form an ink jet printhead cartridge, which is mounted to a printhead carrier. In another such ink jet printer, each ink tank may be mounted to a printing head that is separately mounted to a printhead carrier.

One challenge in an ink jet imaging apparatus, for example, is how to insure that, when printing using removable supply cartridges, the set of supply cartridges are mounted correctly. For example, assume a system having an ink tank that is removably mounted to a printhead that is separately mounted to a carrier. In this example, if the ink tank is not mounted firmly in its proper place with respect to the printhead, the ink-flow circuit will be broken and the printing head may run dry and xease to function correctly.

One approach in monitoring the correct mounting of a supply cartridge is to use an electrical contact system that completes an electrical circuit when the supply cartridge is correctly mounted to the carrier. However, such electrical contact systems typically require complicated wire harnessing systems.

SUMMARY OF THE INVENTION

The present invention facilitates determination of proper supply cartridge installation in an imaging apparatus.

The invention, in one form thereof, is directed to a supply cartridge for containing a supply of imaging substance. The supply cartridge includes a cartridge body, and a light pipe attached to the cartridge body. the light pipe has a light output, and a light inout for receiving light from an external light source.

The invention, in another form thereof, is directed to an imaging apparatus, The imaging apparatus includes a print engine having a plurality of supply cartridge bays, and a light source for generating light. A plurality of supply cartridges is provided, wherein each supply cartridge of the plurality of supply cartridges is installed in a respective bay of the plurality of supply cartridge bays. Each supply cartridge has a respective light pipe, wherein when the plurality of supply cartridges are properly installed in the plurality of supply cartridge bays, the light is transferred through each respective light pipe. A light reception device receives the light transferred through each respective light pipe.

The invention, in another form thereof, is directed to a method for determining whether a plurality of supply cartridges is properly installed in an imaging apparatus. The method includes arranging in the imaging apparatus the plurality of supply cartridges, the plurality of supply cartridges having a corresponding plurality of light pipes sequentially arranged; and determining whether the plurality of supply cartridges is properly installed in the imaging apparatus based on an amount of light transmitted through the corresponding plurality of sequentially arranged light pipes.

The invention, in another for thereof, is directed to an imaging apparatus. The imaging apparatus includes a print engine having a plurality of supply cartridge bays, a light source for generating light, and a light detector for receiving the light. Each supply cartridge of a plurality of supply cartridges is installed in a respective bay of the plurality of supply cartridge bays. Each supply cartridge has a respective first light pipe and a respective second light pipe. When the plurality of supply cartridges are properly installed in the plurality of supply bays, the plurality of respective first light pipes of the plurality of supply cartridges define a first light path and the plurality of respective second light pipes of the plurality of supply cartridges define a second light path. The light is transferred from the light source along the first light path and along the second light path to the light detector.

BRIEF DESCRIPTION OF THE DRAWINGS

The above-mentioned and other features and advantages of theis invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DESCRIPTION OF THE PREFERRED EMBODIMENT

Figure 1:
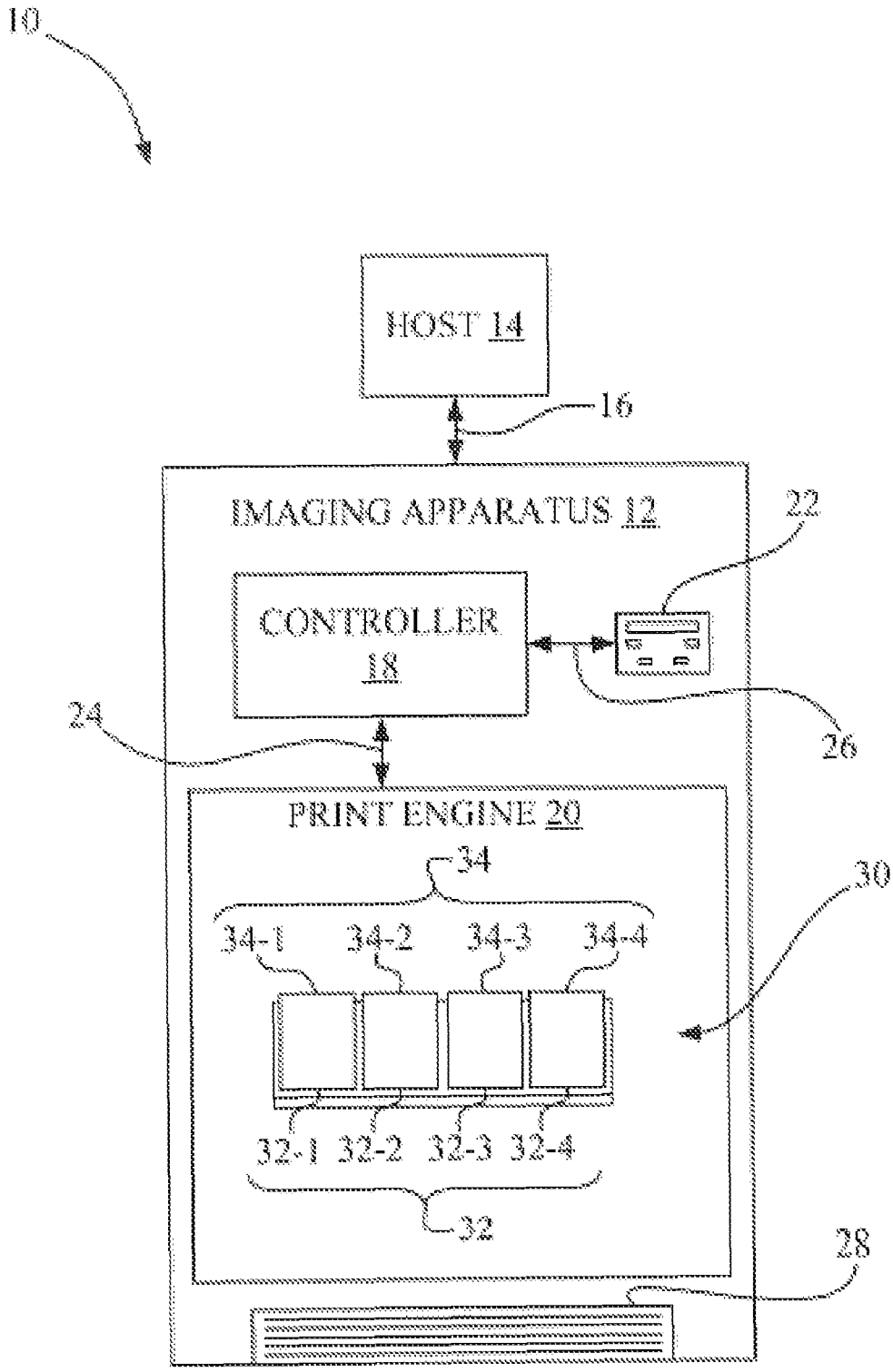
FIG. 1 is a diagrammatic depiction of a system embodying the present invention.

Referring to FIG. 1, there is shown a diagrammatic depiction of an imaging system 10 embodying the present invention. Imaging system 10 may include an imaging apparatus 12 and a host 14. Imaging apparatus 12, when configured for example as a printer, communicates with host 14 via a communications link 16. As used herein, the term "communications link" is used to generally refer to structure that facilitates electronic communication between multiple components, and may operate using wired or wireless technology.

Host 14 may be, for example, a personal computer. During operation, host 14 includes in its memory a software program including program instructions that function as an imaging driver, e.g., printer driver software, for imaging apparatus 12. The imaging driver facilitates communication between imaging apparatus 12 and host 14, and may provide formatted print data to imaging apparatus 12.

Alternatively, imaging apparatus 12 may be a standalone unit that is not communicatively linked to a host, such as host 14. For example, imaging apparatus 12 may take the form of a multifunction machine that includes standalone copying and facsimile capabilities, in addition to optionally serving as a printer when attached to a host, such as host 14.

Imaging apparatus 12 may include, for example, a controller 18, a print engine 20, and a user interface 22.

Controller 18 includes a processor unit and associated memory, and may be formed as an Application Specific Integrated Card (ASIC). Controller 18 may be configured, for example, to support printing and/or other functions, and as such, may include a printer driver and/or a scanner driver for providing formatted print data to print engine 20.

Controller 18 communicates with print engine 20 via a communications link 24. Controller 18 communicates with user interface 22 via a communications link 26. Communications links 24 and 26 may be established, for example, by using standard electrical cabling or bus structures, or by wireless connection Print engine 20 may be, for example, an ink jet print engine or an electrophotographic print engine, for forming an image on a sheet of print media 28, such as a sheet of paper, transparency or fabric, in a manner known in the art.

Print engine 20 includes a cartridge receptacle 30 including a plurality of supply cartridge bays 32, individually identified as bay 32-1, bay 32-2, bay 32-3, and bay 32-4. The plurality of supply cartridge bays 32 is configured to receive a corresponding plurality of supply cartridges 34, individually identified as supply cartridge 34-1, supply cartridge 34-2, supply cartridge 34-3, and supply cartridge 34-4. For example, in embodiments where print engine 20 is an ink jet print engine, cartridge receptacle 30 may be a reciprocating carrier that is configured to mount two or more removable ink jet printhead cartridges, or alternatively, cartridge receptacle 30 may mount semi-permanently installed ink jet printheads and be configured to mount two or more removable ink tanks.

While cartridge receptacle 30 includes four bays 32 in this example, those skilled in the art will recognize that the number of bays is arbitrary, and the actual number of bays 32 and associated supply cartridges 34 may be dependent on the imaging application in which imaging apparatus 12 is to be used.

Figure 2:
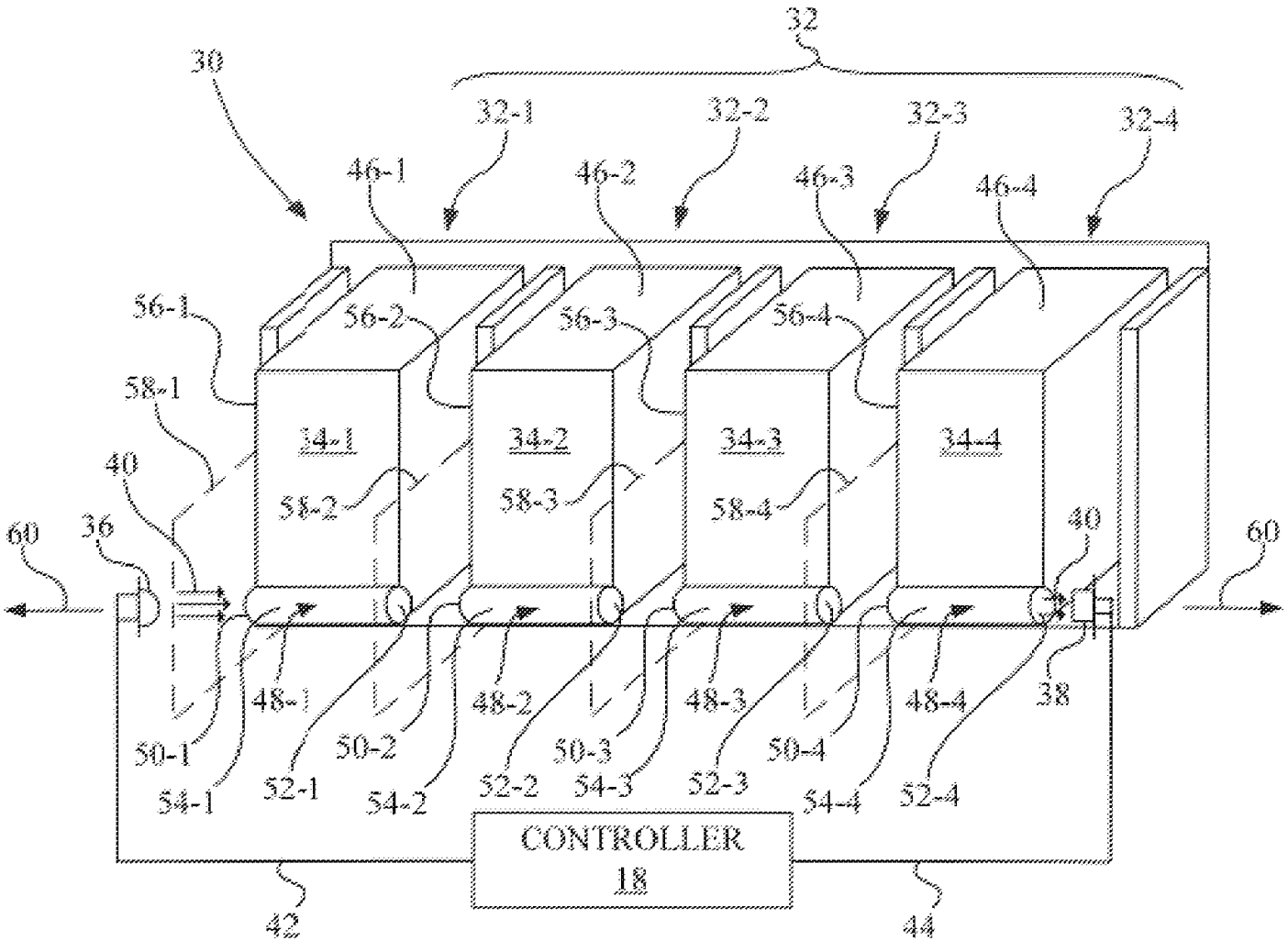
FIG. 2 is a diagrammatic perspective view of an embodiment of the present invention.

Referring now ot FIG. 2, there is shown a diagrammatic illustration of a portion of imaging apparatus 12 in accordance with an embodiment of the present invention. Imaging apparatus 12 further includes a light source 36 and a light detector 38. Light source 36 generates light 40, and may be, for example, a lamp or a light emitting diode (LED). Light detector 38 may be, for example, a photo-detection device, such as a photodiode or a phototransistor.

Light source 36 is communicatively coupled to controller 18 via a communication link 42. Light detector 38 is communicatively coupled to controller 18 via a communication link 44. Light source 36 may be mounted, for example, on the structure of imaging apparatus 12, such as on cartridge receptacle 30. Light source 36 may be selectively energized, for example, by a signal received from controller 18. Light detector 38 is positioned to be spaced apart from light source 36. Light detector 38 may be mounted, for example, on the structure of imaging apparatus 12, such as on cartridge receptacle 30, or may be mounted on one of the supply cartridges, such as supply cartridge 34-4.

Each supply cartridge 34-1, 34-2, 34-3, 34-4 of the plurality of supply cartridges 34 is installed in a respective bay of the plurality of supply cartridge bays 32. Supply cartridge 34-1 has a cartridge body 46-1, and a respective light pipe 48-1 attached to cartridge body 46-1. Supply cartridge 34-2 has a cartridge body 46-2, and a respective light pipe 48-2 attached to cartridge body 46-2. Supply cartridge 34-3 has a cartridge body 46-3, and a respective light pipe 48-3 attached to cartridge body 46-3. Supply cartridge 34-4 has a cartridge body 46-4 and a respective light piep 48-4 attached to cartridge body 46-4. Attachment may be made, for example, by forming the light pipe integral with the cartridge body, e.g., by molding the light pipe into the cartridge body. Alternative, for example, the light piep may be connected to a component of the supply cartridge, such as a wall surface, e.g., a facade, or a top, bottom or sidewall, of the respective cartridge body. Each of light pipes 48-1, 48-2, 48-3 and 48-4 may be, for example, a vloume formed with a transmissive solid, for example, a cylindrical, rectangular, trapezoidal, etc., solid composed of acrylic, polycarbonate, polypropylene, etc., material.

Light pipe 48-1 includes a light inout 50-1, a light output 52-1, and a straight-line light path 54-1 between light input 50-1 and light output 52-1. Light pipe 48-2 includes a light input 50-2, a light output 52-2, and a straight-line light path 54-2 between light input 50-2 and light output 52-2. Light pipe 48-3 includes a light input 50-3, a light output 52-3, and a straight-line light path 54-3 between light input 50-3 and light output 52-3. Light pipe 48-4 includes a light input 50-4, a light output 52-4, and a straight-line light path 54-4 between light input 50-4 and light output 52-4.

In this embodiment, cartridge body 46-1 includes a side 56-1 that defines a plane 58-1. Straight-line light path 54-1 of light pipe 48-1 is positioned to be perpendicular to plane 58-1. Cartridge body 46-2 includes a side 56-2 that defines a plane 58-2. Straight-line light path 54-2 of light pipe 48-2 is positioned to be perpendicular to plane 58-2. Cartridge body 46-3 includes a side 56-3 that defines a plane 58-3. Straight-line light path 54-3 of light pipe 48-3 is positioned to be perpendicular to plane 58-3. Cartridge body 46-4 includes a side 56-4 that defines a plane 58-4. Straight-line light path 54-4 of light pipe 48-4 is positioned to be perpendicular to plane 58-4. In this example, planes 58-1, 58-2, 58-3 and 58-4 are vertical planes, and are substantially parallel.

In this embodiment, when the plurality of supply cartridges 34 are properly installed in the respective plurality of supply cartridge bays 32, light pipes 48-1, 48-2, 48-3, and 48-4 are axially aligned along an axis 60, and light source 36 is optically connected to light detector 38. As such, a majority of light 40 supplied by light source 36 that enters light input 50-1 of light pipe 48-1 is transferred sequentially through light pipes 48-2, 48-3 and 48-4 and is received at light detector 38. Light detector 38 then sends a detection signal via communication link 44 to controller 18 for measurement. Controller 18 executes program instructions to determine whether the plurality of supply cartridges 34 is properly installed in imaging apparatus 12 based on the amount of light transmitted through the corresponding plurality of sequentially arranged light pipes 48-1, 48-2, 48-3, and 48-4. For example, controller 18 may execute program instructions to determine whether the measured amount of light is within a predefined range associated with the plurality of supply cartridges 34 being properly installed in imaging apparatus 12.

The range may be, for example, in termas of a voltage output of light detector 38. For example, a voltage output in the range of 1.4 volts to 1.6 volts may be predefined to signify proper installation of each of supply cartridges 34-1, 34-2, 34-3 and 34-4 in the respective supply cartridge bays 32-1, 32-2, 32-3 and 32-4.

If the amount of measured light is within thwe predetermined range, each of the plurality of supply cartridges 34 is properly installed in the respective plurality of supply cartridge bays 32 of imaging apparatus 12. However, if the amount of measured light is not within the predefined range, then at least one of the plurality of supply cartridges 34 is not properly installed in imaging apparatus 12. As such, a warning message may be generated, e.g., by controller 18, and displayed at user interface 22 and/or at host 14. Alternatively, or in addition to the warning message, controller 18 may not enable print engine 20 until corrective action is taken, so as to protect print engine 20 from inadvertent damage, e.g., to protect against premature failure of comopnent parts, e.g., print heads, etc., resulting from performing a printing operation when one or more of the plurality of supply cartridges 34 is not properly installed in the respective plurality of supply cartridge bays 32 of imaging apparatus 12.

Figure 3:
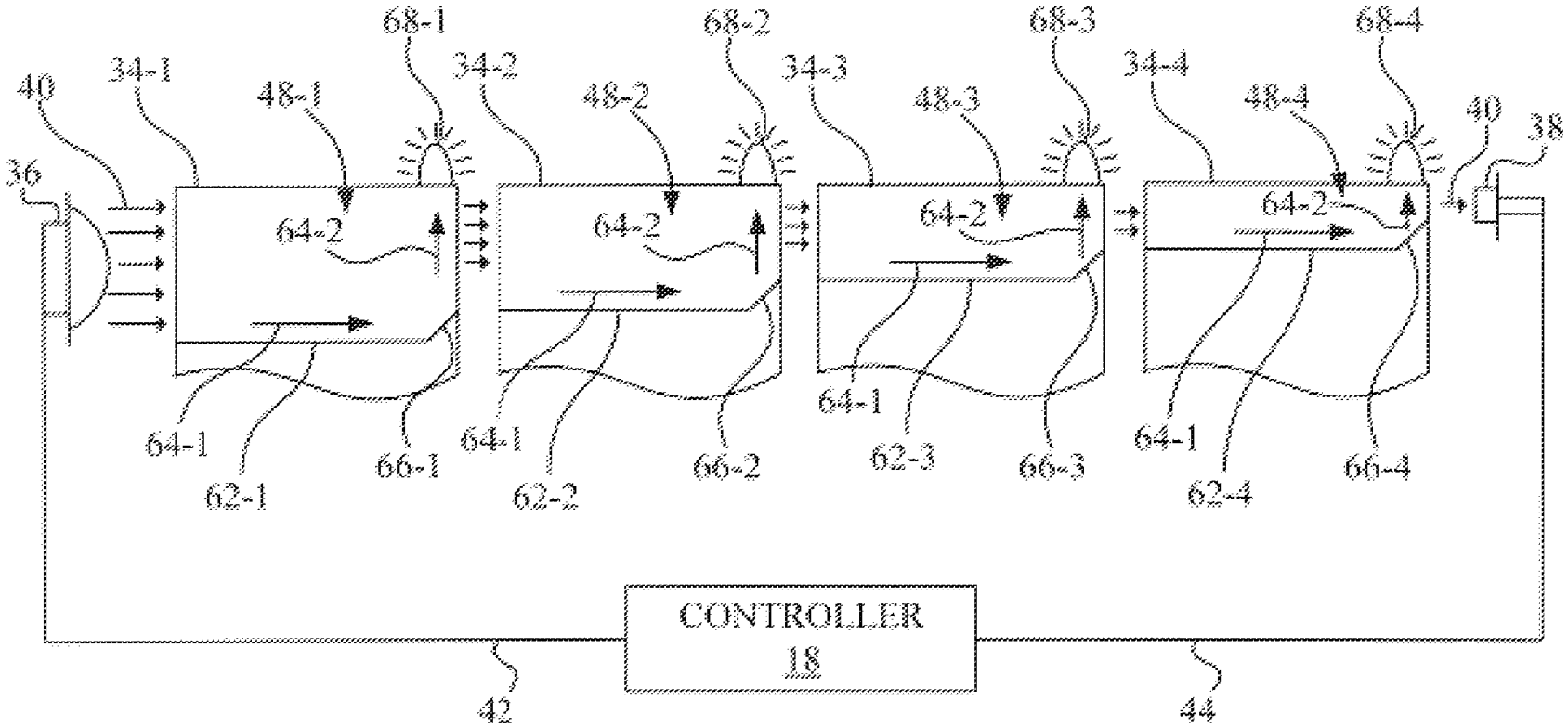
FIG. 3 is diagrammatic illustration of a variation of the embodiment of FIG. 2.

FIG. 3 is a variation of the embodiment of FIG. 2.

In FIG. 3, light pipe 48-1 includes a light pipe segment 62-1 for collecting light and directing light 40 in a first direction 64-1. A reflective surface 66-1 is positioned to intersect light 40 in the first direction 64-1 and redirect light 40 in a second direction 64-2 different from the first direction 64-1. In this embodiment, for example, the second direction 64-2 is orthogonal to the first direction 64-1. An illumination device 68-1 is positioned to receive light 40 traveling in the second direction 64-2. Illumination device 68-1 illuminates upon receiving light 40 traveling in the second direction 64-2 to provide a visual feedback indicating successful reception of light 40 by light pipe 48-1 in the first direction 64-1. In turn, this visual feedback is an indication of proper installation of supply cartridge 34-1 in imaging apparatus 12. Conversely, no visual feedback is an indication that supply cartridge 34-1 is not properly installed in imaging apparatus 12.

In FIG. 3, light pipe 48-2 includes a light pipe segment 62-2 for collecting light and directing light 40 in the first direction 64-1. A reflective surface 66-2 is positioned to intersect light 40 in the first direction 64-1 and redirect light 40 in the second direction 64-2. An illumination device 68-2 is positioned to receive light 40 traveling in the second direction 64-2. Illumination device 68-2 illuminates upon receiving light 40 traveling in the second direction 64-2 to provide a visual feedback indicating successful reception of light 40 by light pipe 48-2 in the first direction 64-1. In turn, this visual feedback is an indication of proper installation of supply cartridge 34-2 in imaging apparatus 12. Conversely, no visual feedback is an indication that supply cartridge 34-2 is not properly installed in imaging apparatus 12.

In FIG. 3, light pipe 48-3 includes a light pipe segment 62-3 for collecting light and directing light 40 in the first direction 64-1. A reflective surface 66-3 is positioned to intersect light 40 in the first direction 64-1 and redirect light 40 in the second direction 64-2. An illumination device 68-3 is positioned to receive light 40 traveling in the second direction 64-2. Illumination device 68-3 illuminates upon receiving light 40 traveling in the second direction 64-2 to provide a visual feedback indicating successful reception of light 40 by light pipe 48-3 in the first direction 64-1. In turn, this visual feedback is an indication of proper installation of supply cartridge 34-3 in imaging apparatus 12. Conversely, no visual feedback is an indication that supply cartridge 34-3 is not properly installed in imaging apparatus 12.

In FIG. 3, light pipe 48-4 includes a light pipe segment 62-4 for collecting light and directing light 40 in the first direction 64-1. A reflective surface 66-4 is positioned to intersect light 40 in the first direction 64-1 and redirect light 40 in the second direction 64-2. An illumination device 68-4 is positioned to receive light 40 traveling in the second direction 64-2. Illumination device 68-4 illuminates upon receiving light 40 traveling in the second direction 64-2 to provide a visual feedback indicating successful reception of light 40 by light pipe 48-4 in the first direction 64-1. In turn, this visual feedback is an indication of proper installation of supply cartridge 34-4 in imaging apparatus 12. Conversely, no visual feedback is an indication that supply cartridge 34-4 is not properly installed in imaging apparatus 12.

Each of illumination devices 68-1, 68-2, 68-3 and 68-4 may be, for example, a passive device that does not require or use electrical power, such as a light transmissive structire having a prominent surface visible to a user that illuminates when it receives light. The light transmissive structure may be composed of, for example, acrylic, polycarbonate, polypropylene, etc., material. Alternatively, such illumination devices may be formed by an active system using electronic sensors and light emitters.

As illustrated in FIG. 3, the reflective surfaces 66-1, 66-2, 66-3 and 66-4 are offset from one another in direction 64-2. While some light 40 is diverted by the reflective surfaces 66-1, 66-2, 66-3 and 66-4 to illuminate respective illumination devices 68-1, 68-2, 68-3 and 68-4 when respective supply cartridges 34-1, 34-2, 34-3 and 34-4 are properly installed in imaging apparatus 12, a remainder of light 40 is transferred through light pipes 48-1, 48-2, 48-3 and 48-4 to light detector 38, and a determination of whether the plurality of supply cartridges 34 is properly installed in imaging apparatus 12 may be performed as discussed above with respect to FIG. 2.

Figure 4:
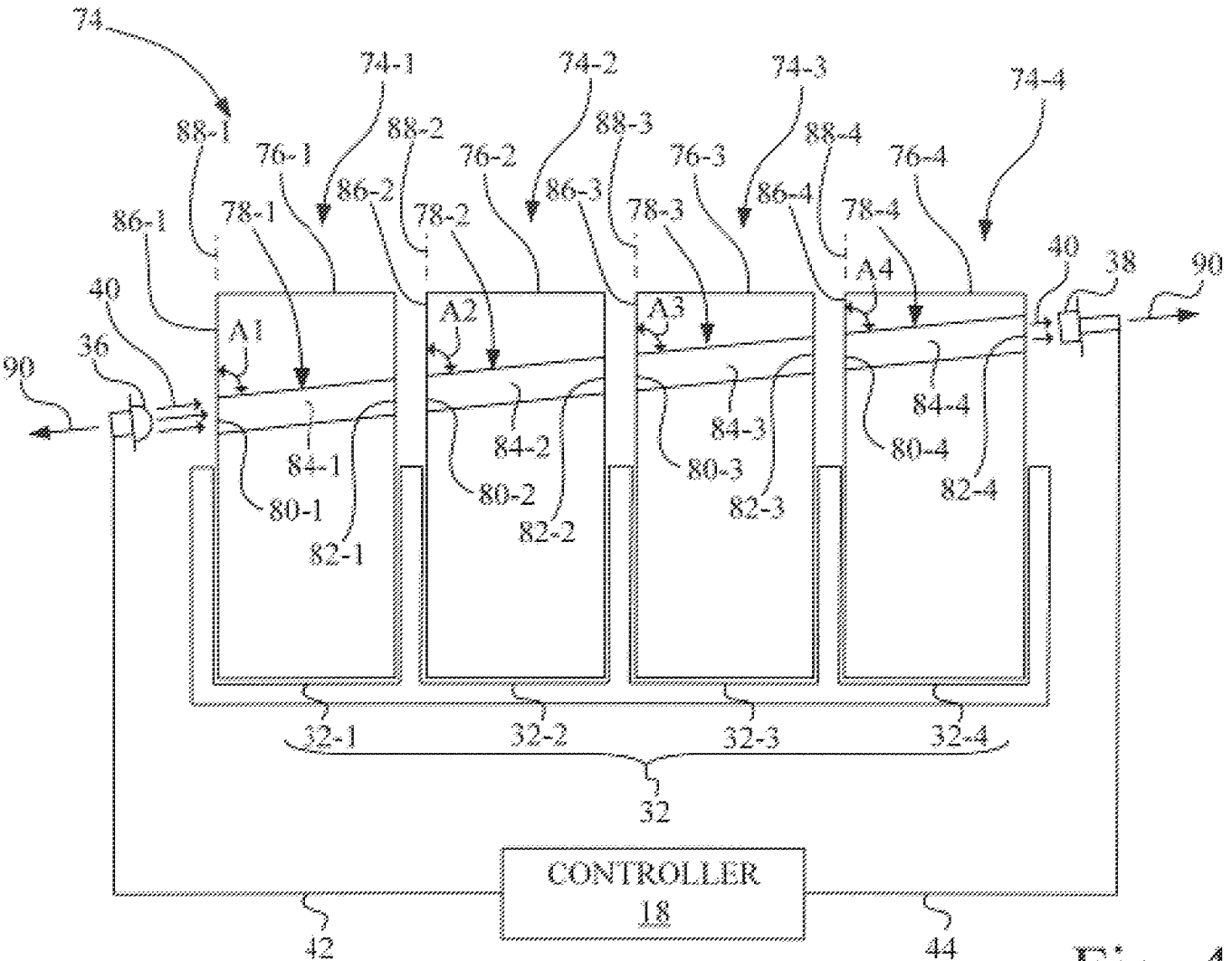
FIG. 4 is a diagrammatic illustration of another embodiment of the present invention.

Referring now to FIG. 4, there is shown a diagrammatic illustration of another embodiment of the present invention. In this embodiment, a plurality of supply cartridges 74 is substituted for the plurality of supply cartridges 34 of the previous embodiments. Also, the location and orientation of light source 36 and light detector 38 are changed somewhat to accommodate the configuration of the plurality of supply cartridges 74.

Each supply cartridge 74-1, 74-2, 74-3, 74-4 of the plurality of supply cartridges 74 is installed in a respective bay of the plurality of supply cartridge bays 32. Supply cartridge 74-1 has a cartridge body 76-1, and a respective light pipe 78-1 attached to cartridge body 76-1. Supply cartridge 74-2 has a cartridge body 76-2, and a respective light pipe 78-2 attached to cartirdge body 76-2. Supply casrtridge 74-3 has a cartridge body 76-3, and a respective light pipe 78-3 attached to cartirdge body 76-3. Supply cartridge 74-4 has a cartridge body 76-4 and a respective light pipe 78-4 attached to cartridge body 76-4. Attachment may be made, for example, by forming the light pipe integral with the cartridge body, e.g., by molding the light pipe into the cartridge body. Alternatively, for example, the light pipe may be connected to a component of the supply cartridge, such as a wall surface, e.g., a facade, or a top, bottom or sidewall, of the respective cartridge body. Each of light pipes 78-1, 78-2, 78-3 and 78-4 may be, for example, a transmissive solid, for example, a cylindrical, rectangular, trapezoidal, etc., solid composed of acrylic, polycarbonate, polypropylene, etc., material.

Light pipe 78-1 includes a light input 80-1, a light output 82-1, and a straight-line light path 84-1 between light input 80-1 and light output 82-1. Light pipe 78-2 includes a light input 80-2, a light output 82-2, and a straight-line light path 84-2 between light input 80-2 and light output 82-2. Light pipe 78-3 includes a light input 80-3, a light output 82-3, and a straight-line light path 84-3 between light input 80-3 and light output 82-3. Light pipe 78-4 includes a light input 80-4, a light output 82-1, and a straight-line light path 84-4 between light input 80-4 and light output 82-4.

In this embodiment, cartridge body 76-1 includes a side 86-1 that defines a plane 88-1. Straight-line light path 84-1 of light pipe 78-1 is positioned to be disposed at an acute angle A1 with respect to plane 88-1. Cartridge body 76-2 includes a side 86-2 that defines a plane 88-2. Straight-line light path 84-2 of light pipe 78-2 is positioned to be disposed at an acute angle A2 with respect to plane 88-2. Cartridge body 76-3 includes a side 86-3 that defines a plane 88-3. Straight-line light path 84-3 of light pipe 78-3 is positioned to be disposed at an acute angle A3 with respect to plane 88-3. Cartridge body 76-4 includes a side 86-4 that defines a plane 88-4. Straight-line light path 84-4 of light pipe 78-4 is positioned to be disposed at an acute angle A4 with respect to plane 88-4. In this example, planes 88-1, 88-2, 88-3 and 88-4 are vertical planes, and are substantially parallel.

In this embodiment, when the plurality of supply cartridges 34 are properly installed in the respective plurality of supply cartridge bays 32, light pipes 78-1, 78-2, 78-3, and 78-4 are axially aligned along an axis 90, and light source 36 is optically connected to light detector 38. As such, a majority of light supplied by light source 36 that enters light input 80-1 of light pipe 78-1 is transferred sequentially through light pipes 78-2, 78-3 and 78-4 and is received at light detector 38. Light detector 38 then sends a detection signal via communication link 44 to controller 18 for measurement. Controller 18 executes program instructions to determine whether the plurality of supply cartridges 74 is properly installed in imaging apparatus 12 based on the amount of light transmitted through the corresponding plurality of sequentially arranged light pipes 78-1, 78-2, 78-3, and 78-4. For example, controller 18 may execute program instructions to determine whether the measured amount of light is within a predefined range associated with the plurality of supply cartridges 74 being properly installed in imaging apparatus 12.

If the amount of measured light is within the predefined range, each of the plurality of supply cartridges 74 is properly installed in the respective plurality of supply cartridge bays 32 of imaging apparatus 12.

However, if the amount of measured light is not within the predefined range, then at least one of the plurality of supply cartridges 74 is not properly installed in imaging apparatus 12. As such, a warning message may be generated, e.g., by controller 18, and displayed at user interface 22 and/or at host 14. Alternatively, or in addition to the warning message, controller 18 may not enable print engine 20 until corrective action is taken, so as to protect print engine 20 from inadvertent damage, e.g., to protect against premature failure of component parts, e.g., print heads, etc., resulting from performing a printing operation when one or more of the plurality of supply cartridges 74 is not properly installed in the respective plurality of supply cartridge bays 32 of imaging apparatus 12.

In the embodiment of FIG. 4, it possible to determine whether one or more of the respective supply cartridges 74-1, 74-2, 74-3 and 74-4 is not properly seated in the plurality of supply cartridge bays 32. In addition, by arranging the respective light pipes 78-1, 78-2, 78-3, and 78-4 to lie on an angle, e.g., an acute angle, and by positioning light pipes 78-1, 78-2, 78-3, and 78-4 to be axially aligned along an axis 90 when supply cartridges 74-1, 74-2, 74-3 and 74-4 are properly seated in the plurality of supply cartridge bays 32, it is possible to determine whether a supply cartridge, even if properly seated, is located in the proper bay of the plurality of supply cartridge bays 32, e.g., is in the proper order. For example, as is evident from FIG. 4, if the positions of supply cartridge 74-1 and supply cartridge 74-3 were reversed, then the light pipes 78-1, 78-2, 78-3, and 78-4 of respective supply cartridges 74-1, 74-2, 74-3 and 74-4 will no longer be axially aligned along an axis 90, thereby substantially blocking light 40 from being received by light detector 38 from light source 36.

Accordingly, for a particular supply cartridge, e.g., supply cartridge 74-2, a position of the resepctive light pipe, e.g., light pipe 78-2, with respect to the respective cartridge body, e.g., cartridge body 76-2, may be made to be dependent on, i.e., being representative of, a characteristic of the particular supply cartridge. The characteristic may be, for example, related to an installation position, e.g., a predefined order of the plurality of supply cartridges 74 in supply cartridge bays 32 from left to right, based on the imaging substance color, e.g., ink color, contained in the respective supply cartridges 74-1, 74-2, 74-3, amd 74-4. For example, the color sequence from left to right may be cyan, yellow, magenta and black. As another example, the characteristic may be, for example, related to a cartridge type, e.g., pigment versus dye-based inks, dilute versus full strength inks, black versus color inks, etc. As a still further example, the characteristic may be identification of a particular cartridge manufacturer or vendor.

Figure 5:
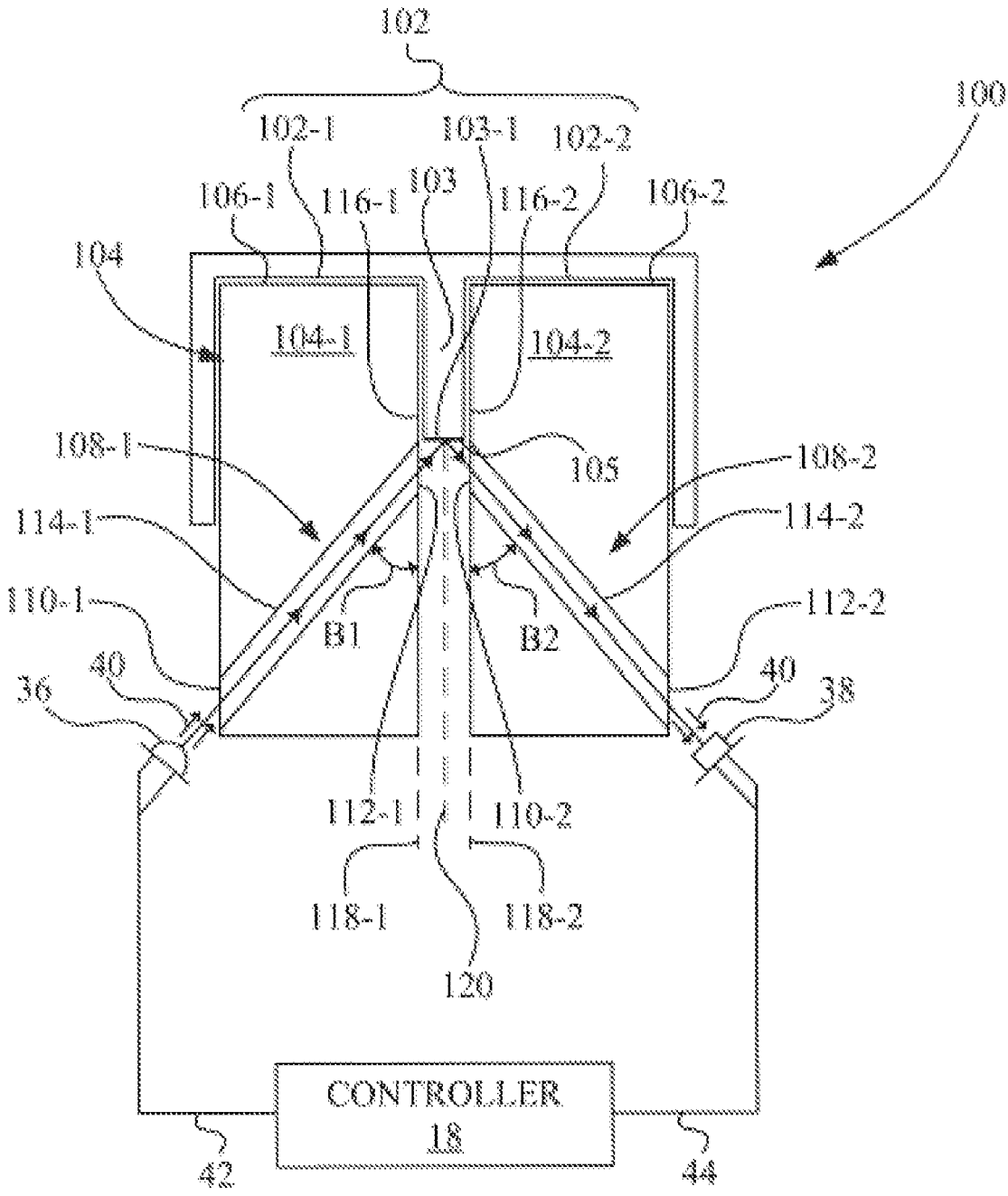
FIG. 5 is a diagrammatic illustration of another embodiment of the present invention.

FIG. 5 a diagrammatic illustration of another embodiment of the present invention, including a cartridge receptacle 100, which may be substituted for the cartridge receptacle 30 of FIG. 1. Cartridge receptacle 100 includes a plurality of supply cartridge bays 102, individually identified as bay 102-1 and bay 102-2. Supply cartridge bay 102-1 is separated from supply cartrtidge bay 102-2 by a wall 103. At least a portion of an end 103-1 of wall 103 has a reflective surface 105.

The plurality of supply cartridge bays 102 is configured to receive a corresponding plurality of supply cartridges 104, individually identified as supply cartridge 104-1 and supply cartridge 104-2.

Each supply cartridge 104-1, 104-2 of a plurality of supply cartridges 104 is installed in a respective bay of the plurality of supply cartridge bays 102. Supply cartridge 104-1 has a cartridge body 106-1, and a respective light pipe 108-1 attached to cartridge body 106-1. Supply cartridge 104-2 has a cartridge body 106-2, and a respective light pipe 108-2 attached to cartridge body 106-2. Attachment may be made, for example, by forming the light pipe integral with the cartridge body, e.g., by molding the light pipe into the cartridge body. Alternatively, for exaxmple, the light pipe may be connected to a component of the supply cartridge, such as a wall surface, e.g., a facade, or a top, bottom or sidewall, of the respective cartridge body. Each of light pipes 108-1 and 108-2 may be, for example, a transmissive solid, for example, a cylindrical, rectangular, trapezoidal, etc., solid composed of acrylic, polycarbonate, polypropylene, etc., material.

Light pipe 108-1 includes a light input 110-1, a light output 112-1, and a straight-line light path 114-1 between light input 110-1 and light output 112-1. Light pipe 108-2 includes a light input 110-2, a light output 112-2, and a straight-line light path 114-2 between light input 110-2 and light 112-2.

In this embodiment, cartridge body 106-1 includes a side 116-1 that defines a plane 118-1. Straight-line light path 114-1 of light pipe 108-1 is positioned to be disposed at an acute angle B1 with respect to plane 118-1. Cartridge body 106-2 includes a side 116-2 that defines a plane 118-2. Srtaight-line light path 114-2 of light pipe 108-2 is positioned to be disposed at an acute angle B2 with respect to plane 118-2. In this embodiment, angles B1 and B2 are substantially equal complementary angles with respect to a normal line 120 extending from reflective surface 105.

Light pipe 108-1 is positioned to receive light from light source 36. Light pipe 108-1, light pipe 108-2 and reflective surface 105 are oriented such that when supply cartridge 104-1 is properly installed in supply cartridge bay 102-1 and supply cartridge 104-2 is properly installed in supply cartridge bay 102-2, then light source 36 is optically connected to light detector 38. For example, light 40 is transferred from the light output 12-1 of light pipe 108-1 via reflective surface 105 to light input 110-2 of light pipe 108-2. Light 40 is then delivered by light pipe 108-2 to light detector 38.

If the amount of measured light is within the predefined range, each of the plurality of supply cartridges 104 is properly installed in the respective plurality of supply cartridge bays 102 of imaging apparatus 12. However, if the amount of measured light is not within the predefined range, then at least one of the plurality of supply cartridges 104 is not properly installed in imaging apparatus 12. As such, a warning message may be generated, e.g., by controller 18, and displayed at user interface 22 and/or at host 14. Alternatively, or in addition to the warning message, controller 18 may not enable print engine 20 until corrective action is taken, so as to protect print engine 20 from inadvertent damage, e.g., to protect against premature failure of component parts, e.g., print heads, etc., resulting from performing a printing operation when one or more of the plurality of supply cartrigdes 104 is not properly installed in the respective plurality of supply cartridge bays 102 of imaging apparatus 12.

In the embodiment of FIG. 5, like FIG. 4, it is possible to determine whether one or more of the respective supply cartridges 104-1 and 104-2 is not properly seated in the plurality of supply cartridge bays 102. In addition, by arranging the respective light pipes 108-1 and 108-2 at complementary angles B1 and B2, it is possible to determine whether a supply cartridge, even if properly seated, is located in the proper bay of the plurality of supply cartridge bays 102, e.g., in the proper order. For example, as is evident from FIG. 5, if the positions of supply cartridge 104-1 and supply cartridge 104-2 were reversed, or if either or both supply cartridges 104-1, 104-2 are missing, then the light pipes 108-1 and 108-2 and reflective surface 105 will no longer provide a continuous light path, thereby substantially blocking or preventing light 40 from being received by light detector 38 from light source 36.

Accordingly, for a particular supply cartridge, e.g., supply cartridge 104-2, a position of the respective light pipe, e.g., light pipe 108-2, with respect to the respective cartridge body, e.g., cartridge body 106-2, may be made to be dependent on, i.e., being representative of, a characteristic of the particular supply cartridge. The characteristic may be, for example, related to an installation position, e.g., a predefined order of the plurality of supply cartridges 104 in supply cartridge bays 102 from left to right, based on the imaging substance color, e.g., ink color, contained in the respective supply cartridges 104-1 and 104-2. For example, the color sequence from left to right may be chromatic and monochromatic. As another example, the characteristic may be, for example, related to a cartridge type, e.g., pigment versus dye-based inks, dilute versus full strength inks, etc.

Figure 6:
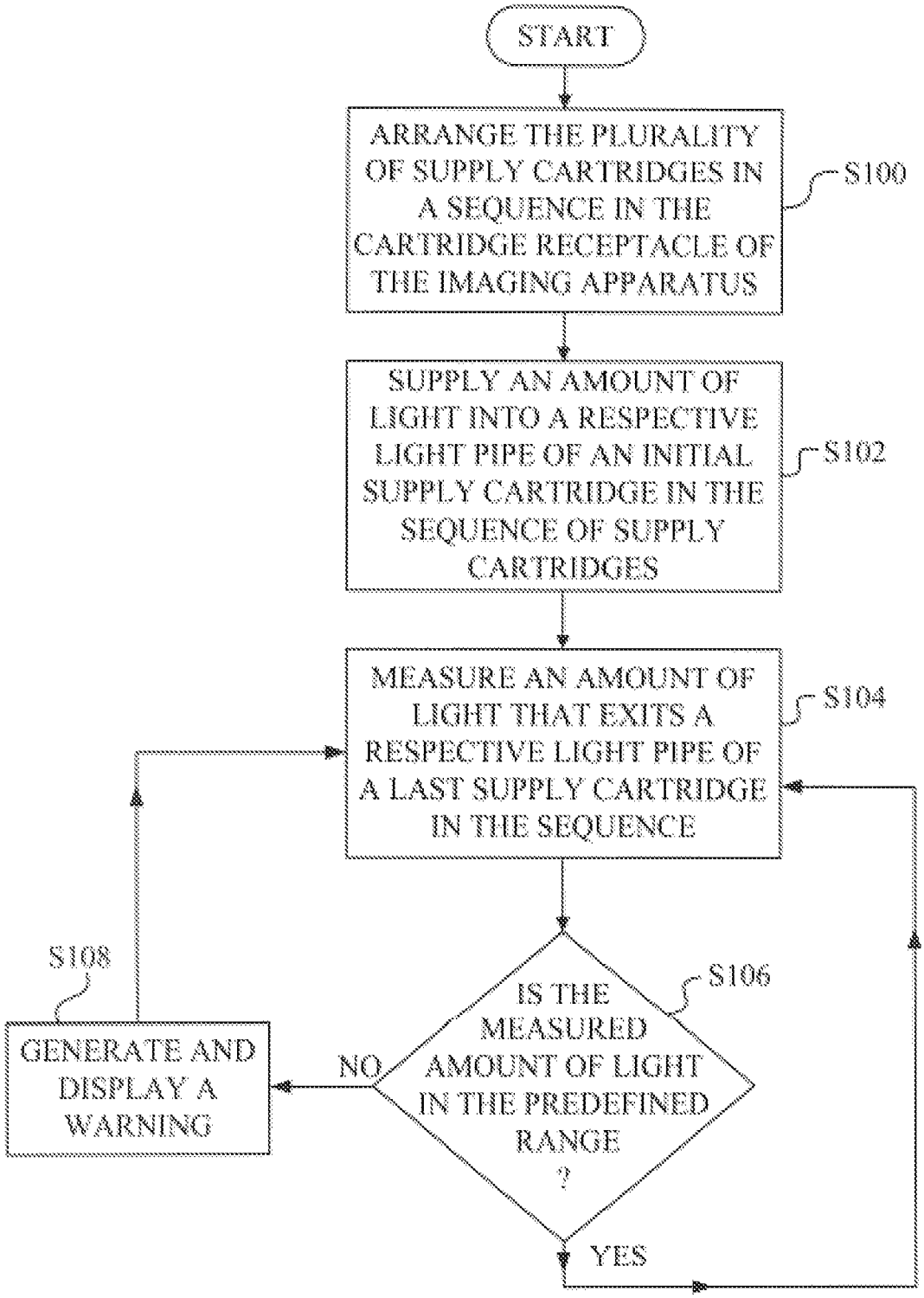
FIG. 6 is a flowchart of an exemplary method for determining whether a plurality of supply cartridges is properly installed in an imaging apparatus.

FIG. 6 is a flowchart of an exemplary method for determining whether a plurality of supply cartridges is properly installed in an imaging apparatus, such as imaging apparatus 12. For purposes of example, the embodiment of FIG. 2 will be used in describing the method.

At step S100, the plurality of supply cartridges 34 are arranged in a sequence in the cartridge receptacle 30 of imaging apparatus 12. The sequence refers to a serial arrangement of individual supply cartridges 34-1, 34-2, 34-3 and 34-4 in respective supply cartridge bays 32-1, 32-2, 32-3 and 32-4.

At step S102, an amount of light is upplied into a respective light pipe 48-1 of an initial supply cartridge 34-1 in the sequence of supply cartridges 34-1, 34-2, 34-3 and 34-4.

At step S104, an amount of light that exits a respective light pipe 48-4 of a last supply cartridge 34-4 in the sequence is measured. the measurement may be made, for example, by controller 18 processing a voltage output signal received from light detector 38.

At step S106, it is determined whether the measured amount of light is within a predefined range associated with the plurality of supply cartridges 34 being properly installed in imaging apparatus 12. This determination may be made, for example, by controller 18 executing program instructions to make the determination.

If at step S106 the determination is YES, then monitoring continues at step S104.

If at step S106 the determination is NO, and thus the measured light is not within the predetermined range, then at least one of the plurality of supply cartrtidges 34 is not properly installed in imaging apparatus 12, and the process proceeds to step S108.

At step S108, an indication of this NO condition at step S106 is made, for example, by generating a warning that at least one of the plurality of supply cartrtidges 34 is not properly installed in imaging apparatus 12. The warning may be in the form of a warning message displayed on user interface 22 of imaging apparatus 12, or on host 14. Monitoring then continues at step S104.

In the previous embodiments, light source 36 and light detector 38 are separated by some distance. For example, in the embodiments represented in FIGS. 2, 3 and 4, the supply cartridges are interposed between light source 36 and light detector 38. In the following embodiments represented in FIGS. 7, 8 and 9, the plurality of supply cartridges 130 are not interposed between light source 36 and light detector 38, and accordingly, light source 36 and light detector 38 may be place in close proximity to each other, and in turn, may be fabricated on the same circuit board, if desired.

Figure 7:
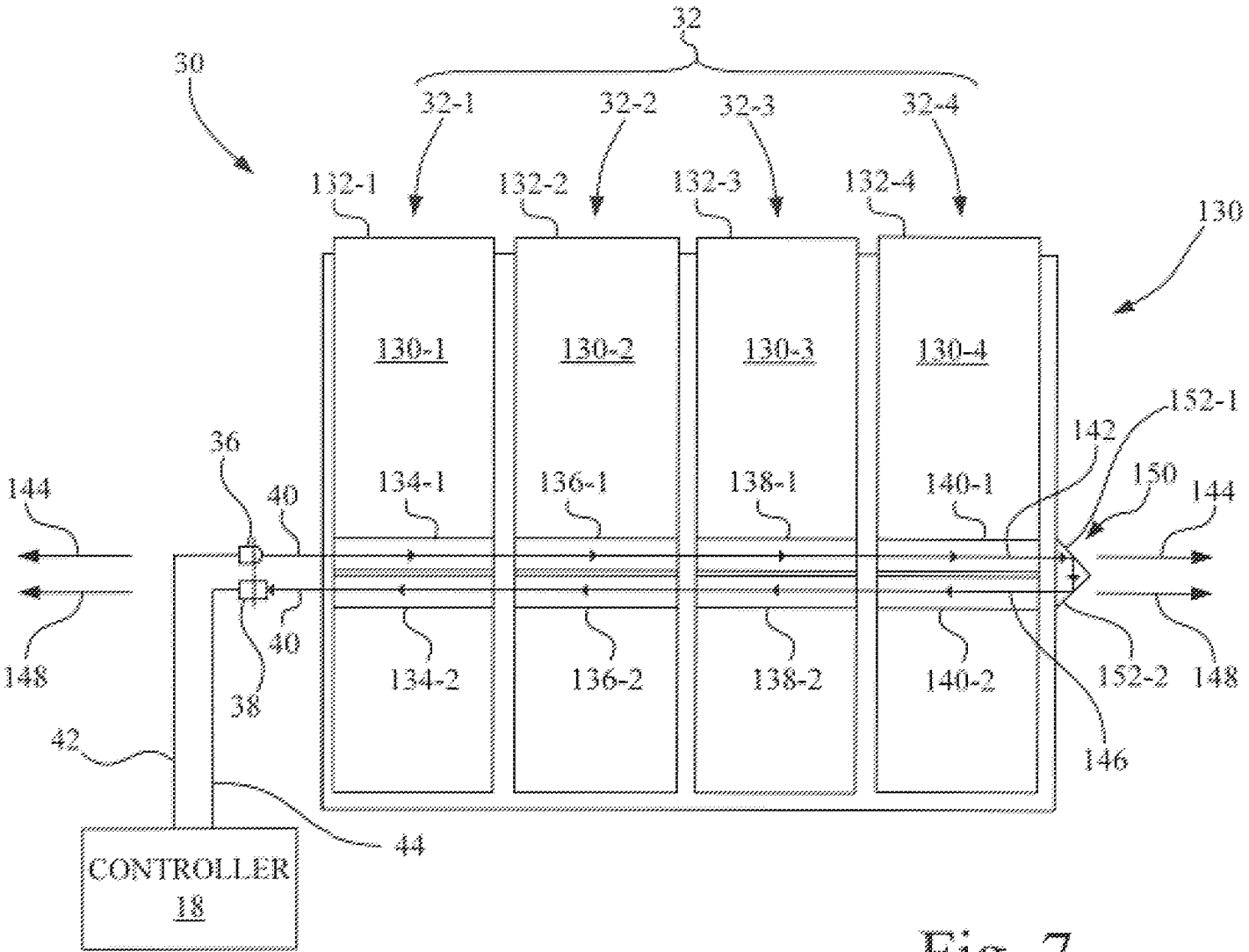
FIG. 7 is a diagrammatic illustration of another embodiment of the present invention.
Figure 8:
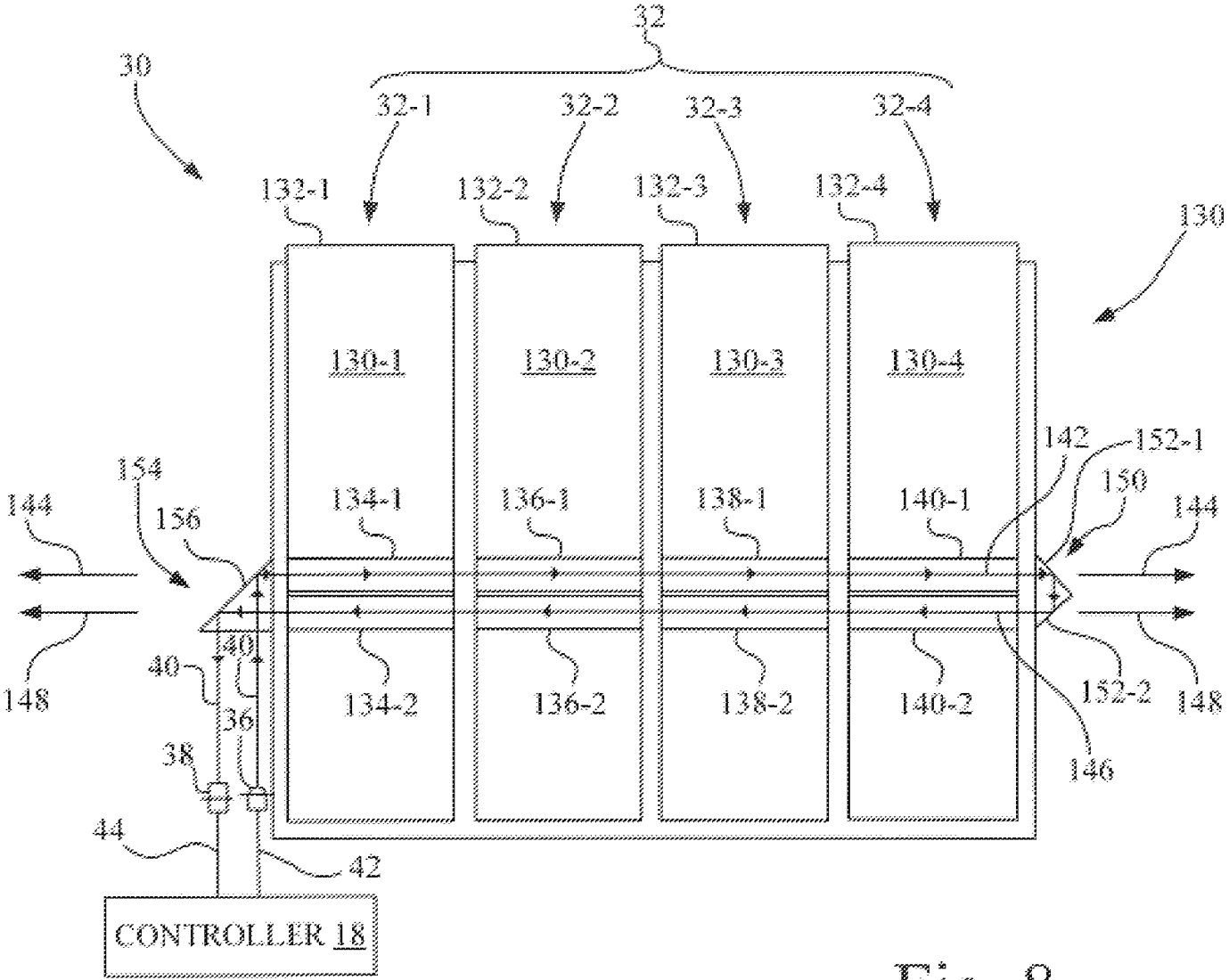
FIG. 8 is a diagrammatic illustration of another embodiment of the present invention.
Figure 9:
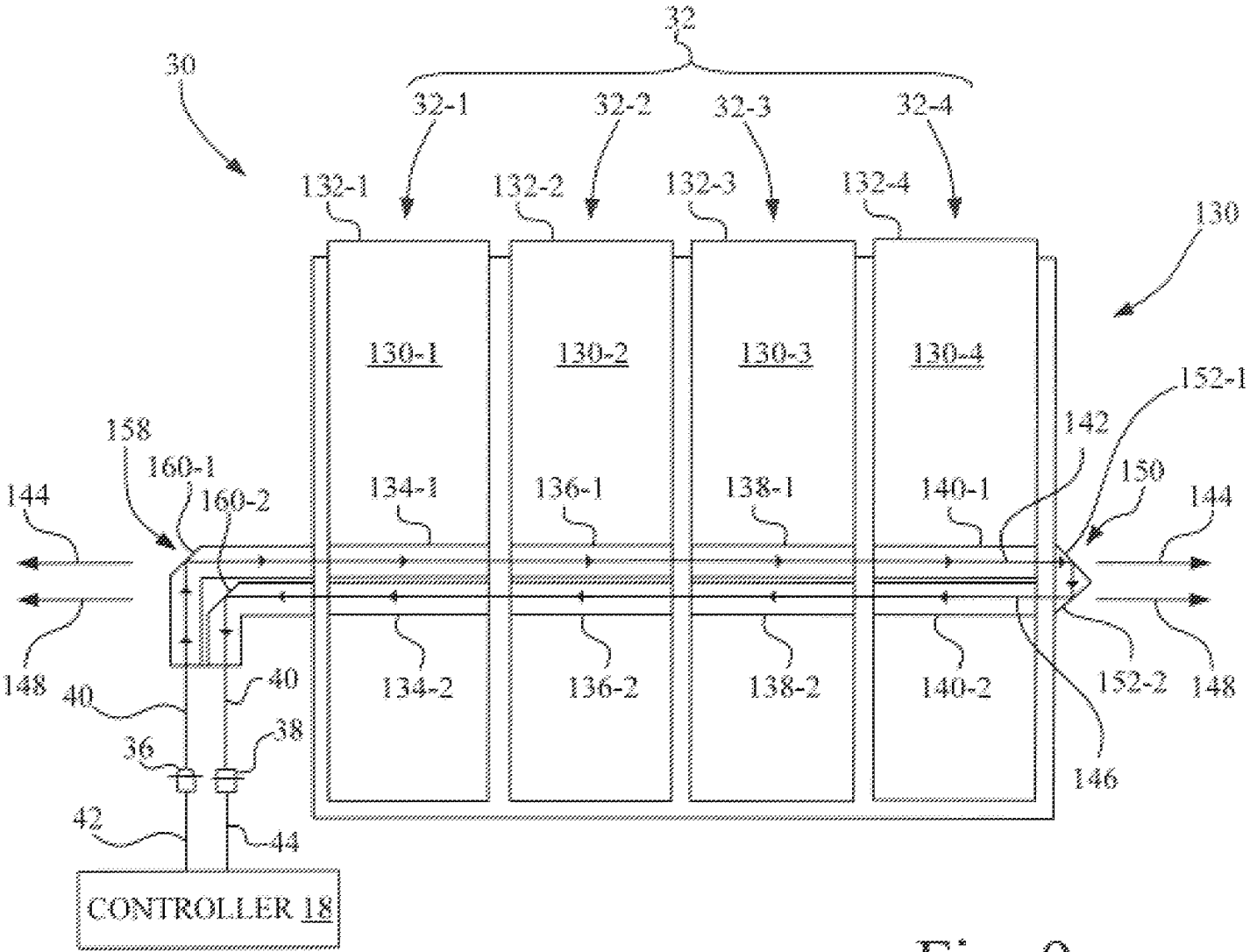
FIG. 9 is a diagrammatic illustration of another embodiment of the present invention.

In the embodiments of FIGS. 7, 8 and 9, the plurality of supply cartridges 130 are individually identified as supply cartridges 130-1, 130-2, 130-3 and 130-4, and are installed in respective supply cartridge bays 32-1, 32-2, 32-2 and 32-4 in a sequence, e.g., from an initial supply cartridge 130-1 to a last supply cartridge 130-4 from left to right as illustrated.

Supply cartridge 130-1 has a cartridge body 132-1, and a respective first light pipe 134-1 and a respective second light pipe 134-2 attached to cartridge body 132-1. Supply cartridge 130-2 has a cartridge body 132-2, and a respective first light pipe 136-1 and a respective second light pipe 136-2 attached to cartridge body 132-2. Supply cartridge 130-3 has a cartridge body 132-3, and a respective first light pipe 138-1 and a respective second light pipe 138-2 attached to cartridge body 132-2. Supply cartridge 130-4 has a cartridge body 132-4, and a respective first light pipe 140-1 and a respective second light pipe 140-2 attached to cartridge body 132-4. Attachment may be made, for example, by forming the light pipes integral with the cartridge body, e.g., by molding the light pipes into the cartridge body. Alternatively, for example, the light pipes may be connected to a component of the supply cartridge, such as a wall surface, e.g., a facade, or a top, bottom, or sidewall, of the respective cartridge body. Each of light pipes 134-1, 134-2, 136-1, 136-2, 138-1, 138-2, 140-1, and 140-2, may be, for example, a transmissive solid, for example, a cylindrical, rectangular, trapezoidal, etc., solid composed of acrylic, polycarbonate, polypropylene, etc., material.

When the plurality of supply cartridges 130 are properly installed in the plurality of supply cartridge bays 32, the plurality of respective first light pipes 134-1, 136-1, 138-1 and 140-1 of the plurality of supply cartridges 130 define a first light path 142 and are axially aligned along a first axis 144, and the plurality of respective second light pipes 134-2, 136-2, 138-2 and 140-2 of the plurality of supply cartridges 130 define a second light path 146 and are axially aligned along a second axis 148. In the embodiments represented in FIGS. 7, 8 and 9, for example, first axis 144 is substantially parallel to secind axis 148, and in turn, first light path 142 is substantially parallel to second light path 146. Also, firts light path 142 and second light path 146 may be located in vertical alignment, or may be offset vertically, if desired.

A reflector device 150 is interposed between the first light path 142 and the second light path 146 to guide light 40 from the first light path 142 to the second light path 146. Reflector device 150 may include, for example, two reflective surfaces 152-1, 152-2 that are arranged to provide the proper angle of incidence with respect to light 40 traveling in first light path 142 such that light 40 is directed along second light path 146. Reflective surfaces 152-1, 152-2 may be formed, for example, from polypropylene, and may be polished to enhance their respective reflectivity.

For example, in the embodiments represented in FIGS. 7, 8 and 9, the two reflective surfaces 152-1, 152-2 are positioned at approximately 90 degrees relative to each other, and reflective surface 152-1 is positioned relative first axis 144 to define an angle of incidence of approximately 45 degrees. Those skilled in the art will recognize, however, that the angular values given above are exemplary, and may be determined for a particular configuration of light pipes and axes orientations, for example, based on trigonometric principles and the material properties of the reflective surfaces 152-1, 152-2, and/or by experimentation.

In the embodiment illustrated in FIG. 7, light 40 is supplied directly from light source 36 to light pipe 134-1 of initial supply cartridge 130-1 and is transported along first light path 142, through light pipes 136-1, 138-1 of intermediate supply cartridges 130-2, 130-3, and through light pipe 140-1 of last supply cartridge 130-4 to reflector device 150. Reflector device 150 receives light 40 that exits light pipe 140-1 of that last supply cartridge 130-4 in the sequence of supply cartridges 130 and directs the received light 40 to the other light pipe 140-2 of last supply cartridge 130-4. Light 40 received by light pipe 140-2 is transferred along second light path 146 to light detector 38.

As such, a majority of light 40 supplied by light source 36 that enters light pipe 134-1 is transferred sequentially through subsequent light pipes 136-1, 138-1, 140-1, 140-2, 138-2, 136-2 and 134-2 and is received at light detector 38 when each of the plurality of supply cartridges 130 is properly installed. Light detector 38 then sends a detection signal via communication link 44 to controller 18 for measurement. Controller 18 executes program instructions to determine whether the plurality of supply cartridges 130 is properly installed in cartridge receptacle 30 of imaging apparatus 12 based on the amount of light transmitted through the corresponding plurality of sequentially arranged light pipes 134-1, 136-1, 138-1, 140-1, 140-2, 138-2, 136-2 and 134-2. For example, controller 18 may execute program instructions to determine whether the measured amount of light is within a predefined range associated with the plurality of supply cartridges 130 being properly installed in imaging apparatus 12, as described above.

However, if the amount of measured light is not within the predefined range, then at least one of the plurality of supply cartridges 130 is not properly installed in imaging apparatus 12. As such, a warning message may be generated, e.g., by controller 18, and displayed at user interface 22 and/or at host 14. Alternatively, or in addition to the warning message, controller 18 may not enable print engine 20 until corrective action is taken, so as to protect print engine 20 from inadvertent damage, e.g., to protect against premature failure of component parts, e.g., print heads, etc., resulting from performing a printing operation when one or more of the plurality of supply cartridges 130 is not properly installed in the respective plurality of supply cartridge bays 32 of imaging apparatus 12.

the embodimemnt of FIG. 8 differs from the embodiment of FIG. 7 by the includsion of a reflector device 154 interposed between light source 36 and first light path 142, interposed between second light path 146 and light detector 38. By using reflector device 154, light source 36 and light detector 38 may be located below, above, in front of, or behind, the plurality of supply cartridges 130.

Reflector device 154 may include, for example, a single reflective surface 156 that is arranged to provide the proper angle of incidence with respect to light 40 received from light source 36 such that light 40 is directed along first light path 142. Likewise, reflective surface 156 is arranged to provide the proper angle of incidence with respect to light 40 received from second light path 146 such that light 40 is directed to light detector 38.

In this embodiment, reflector device 154 directs light 40 supplied by light source 36 to the respective first light pipe 134-1 of the initial supply cartridge 130-1 in the sequence of supply cartridge, and reflector device 154 directs light 40 from the second light pipe 134-2 of initial supply cartridge 130-1 to light detector 38.

the embodiment of FIG. 9 differs from the embodiment of FIG. 7 by the inclusion of a reflector device 158 interposed between light source 36 and first light path 142, and interposed between second light path 146 and light detector 38. Reflector device 158 differs from reflector device 154 of FIG. 8 in that reflector device 158 may include, for example, two reflective surfaces 160-1, 160-2.

Reflective surface 160-1 is arranged to provide the proper angle of incidence with respect to light 40 received from light source 36 such that light source 40 is directed along first light path 142. Likewise, reflective surface 160-2 is arranged to provide the proper angle of incidence with respect to light 40 received from second light path 146 such that light 40 is directed to light detector 38. Reflective surfaces 160-1, 160-2 may be formed, for example, from polypropylene, and may be polished to enhance their respective reflectivity.

Those skilled in the art will recognize that the angular position of reflective surface 160-1 with respect to light source 36 and light pipe 134-1, and the angular position of reflective surface 160-2 with respect to light pipe 134-2 and light detector 38, may be determined, for example, based on trigonometric principles and the material properties of the reflective surfaces 160-1, 160-2, and/or by experimentation.

By integration of a light pipe circuit through the supply cartridges, the system is able to detect if all of the supply cartridges are properly installed and aligned correctly with a single sensor reading. If one of the supply cartridges is missing, misaligned, or in some embodiments out of order, the light will be diffused or blocked, and in turn will decrease the amount of light received by the light receiver, e.g., the illuminating device or the light detector, by a detectable amount, thus indicating the anomaly, thereby permitting corrective action to be taken in a timely manner.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A supply cartridge for containing a supply of imaging substance, comprising:

a cartridge body; and a light pipe attached to said cartridge body, said light pipe having:

a first light output a second light output, and a light input for receiving light from an external light source, wherein a position of said light pipe with respect to said cartridge body is dependent on a characteristic of said supply cartridge, and wherein said characteristic is one of a cartridge manufacturer or vendor, the light pipe further includes:

a first light pipe segment for collecting light received from said light input and directing said light in a first direction toward said first light output; and a reflective surface positioned to intersect said light in said first direction and redirect a portion of said light in a second direction different from said first direction toward said second light output, wherein said second light output is an illumination device positioned on said cartridge body to receive said light in said second direction, said illumination device illuminating upon receiving said light in said second direction to provide a visual feedback indicating successful reception of said light in said first direction.

2. A supply cartridge for containing a supply of imaging substance comprising:

a cartridge body; and a light pipe attached to said cartridge body, said light pipe having:

a first light output a second light output, and a light input for receiving light from an external light source, wherein said cartridge body has a side that defines a plane, and wherein said light pipe includes a straight-line light path that extends from said light input to said light output, said straight-line light path being disposed at an acute angle with respect to said plane, the light pipe further includes:

a first light pipe segment for collecting light received from said light input and directing said light in a first direction toward said first light output; and a reflective surface positioned to intersect said light in said first direction and redirect a portion of said light in a second direction different from said first direction toward said second light output, wherein said second light output is an illumination device positioned on said cartridge body to receive said light in said second direction, said illumination device illuminating upon receiving said light in said second direction to provide a visual feedback indicating successful reception of said light in said first direction.

3. A supply cartridge for containing a supply of imaging substance, comprising:

a cartridge body;

a light pipe attached to said cartridge body, said light pipe having:

a first light output a second light output, and a light input for receiving light from an external light source, wherein said light pipe includes:

a first light pipe segment for collecting light received from said light input and directing said light in a first direction toward said first light output; and a reflective surface positioned to intersect said light in said first direction and redirect portion of said light in a second direction different from said first direction toward said second light output, wherein said second light output is art illumination device positioned on said cartridge body to receive said light in said second direction, said illumination device illuminating upon receiving said light in said second direction to provide a visual feedback indicating successful reception of said light in said first direction.

4. The supply cartridge of claim 3, wherein said illumination device is passive device that illuminates upon receiving said light in said second direction to provide said visual feedback on said supply cartridge indicating successful reception of said light in said first direction.

5. The supply cartridge of claim 4, wherein said visual feedback is an indication of proper installation of said supply cartridge in an imaging apparatus.

6. A supply cartridge for containing a supply of imaging substance, comprising:

a cartridge body; and a light pipe attached to said cartridge body, said light pipe having:

a first light output a second light output, and a light input for receiving light from an external light source, said light pipe being one of a pair of light pipes attached to said cartridge body, wherein the axis of said pair of light pipes are oriented to be substantially parallel, and said pair of light pipes carry light travelling in opposite directions, the light pipe further includes:

a first light pipe segment for collecting light received from said light input and directing said light in a first direction toward said first light output; and a reflective surface positioned to intersect said light in said first direction and redirect a portion of said light in a second direction different from said first direction toward said second light output, wherein said second light output is an illumination device positioned on said cartridge body to receive said light in said second direction, said illumination device illuminating upon receiving said light in said second direction to provide a visual feedback indicating successful reception of said light in said first direction.

7. The supply cartridge of claim 6, wherein said pair of light pipes is formed integral with said cartridge body.

8. The supply cartridge of claim 6, wherein said pair of light pipes is connected to a component of said cartridge body.

* * * * *